US011905100B1

(12) United States Patent
Schneier

(10) Patent No.: US 11,905,100 B1
(45) Date of Patent: Feb. 20, 2024

(54) DISPOSABLE RECEPTACLE TO DISPENSE FLOWABLE SOLUTIONS INTO ORAL CAVITY AND TO COLLECT SAME FROM ORAL CAVITY

(71) Applicant: Lance W. Schneier, Dublin, OH (US)

(72) Inventor: Lance W. Schneier, Dublin, OH (US)

( * ) Notice: Subject to any disclaimer, the term of this patent is extended or adjusted under 35 U.S.C. 154(b) by 0 days.

(21) Appl. No.: 18/310,691

(22) Filed: May 2, 2023

(51) Int. Cl.
*B65D 81/36* (2006.01)
*B65D 75/58* (2006.01)

(52) U.S. Cl.
CPC ..... *B65D 81/361* (2013.01); *B65D 75/5883* (2013.01)

(58) Field of Classification Search
CPC ..... B65D 81/361; B65D 75/5883
USPC ..... 222/566; 220/705–710; 215/388, 389
See application file for complete search history.

(56) References Cited

U.S. PATENT DOCUMENTS 5,328,069 A * 7/1994 Cohanfard ..... A47G 19/2266 215/229
5,957,584 A * 9/1999 Lakey ..... B65D 75/5811 383/906
6,652,144 B2 * 11/2003 Stefandl ..... B65D 77/283 383/200
9,386,870 B2 * 7/2016 Rossitto ..... A47G 21/18
10,071,837 B2 * 9/2018 Franca ..... B65D 47/2031
10,399,750 B1 * 9/2019 Latour ..... B65D 47/0809
2003/0071136 A1 * 4/2003 Ference ..... A47G 21/18 239/33
2006/0015062 A1 * 1/2006 Kahen ..... A44B 15/005 604/77
2007/0108158 A1 * 5/2007 Stribling ..... A45F 3/20 220/666
2008/0308564 A1 * 12/2008 Hall ..... B65D 75/52 220/662
2012/0055942 A1 * 3/2012 Claessens ..... A47G 21/183 220/705
2012/0067910 A1 * 3/2012 Chun ..... A47G 19/2266 220/709
2012/0168450 A1 * 7/2012 Samson ..... B65D 47/2031 220/703
2015/0305528 A1 * 10/2015 Chen ..... A45F 3/20 220/666

* cited by examiner

*Primary Examiner* — Lien M Ngo
(74) *Attorney, Agent, or Firm* — Standley Law Group LLP; James L. Kwak

(57) ABSTRACT

A receptacle having a fitment or straw that allows the user to dispense a flowable solution, typically a liquid, into the oral cavity, and to collect the solution back into the container for disposal. The receptacle contains a solution, such as mouth rinse, which is dispensed into the user's mouth by applying pressure to the receptacle. When the user is finished with the solution, the lips are placed around the straw or fitment, again forming a seal, the solution is expelled and returned into the receptacle without leakage. The straw may contain a baffle to avoid spillage while handling the receptacle with the cap off.

13 Claims, 3 Drawing Sheets

SECTION D-D 5
1
2
D

DISPOSABLE RECEPTACLE TO DISPENSE FLOWABLE SOLUTIONS INTO ORAL CAVITY AND TO COLLECT SAME FROM ORAL CAVITY

BACKGROUND OF THE INVENTIVE FIELD

The present invention is directed to a disposable receptacle to dispense flowable solutions into the oral cavity and to collect same from the oral cavity. The complete system of the present invention allows a user, inter alia to use mouth rinse on-the-go, when there is no sink or place to expel the spent rinse and saliva after the user is finished.

Mouth rinse is needed for three reasons: 1) to maintain healthy teeth and gums; 2) to eliminate food particles that may be visible to others; and 3) to maintain fresh breath. Using mouth rinse is easier when at home or at the office, as there is access to a sink. When away from home or the office, users currently must make do with other, suboptimal options.

The complete system experience includes all the following steps:

Removal of the tethered cap;
Placing lips around protruding straw or fitment;
Pressing sides of receptacle to dispense substance into mouth;
Rinsing substance around the mouth;
Placing lips around straw or fitment;
Expelling spent substance back into receptacle;
Fastening cap back on receptacle; and
Disposing of receptacle.

Currently there is no single, self-contained apparatus that enables all the above steps for full oral rinsing on-the-go. The complete experience of the present invention provides a portable solution to enable users to perform all the tasks necessary to accomplish full rinsing of the mouth.

While mouth rinse is the most typical example, the invention can be used to dispense and collect other flowable substances meant to be dispensed into the oral cavity, but not swallowed. These may include rinses or gargles for sore throats, tonsillitis, mouth sores, gum disease, anti-cavity protection, voice care, etc.

The receptacle could also handle certain food substances, allowing the user to taste food without ingesting. It can also be used to receive wine or liquid tasting remnants from a user's mouth to avoid the user spitting into an open container when tasting.

SUMMARY OF THE INVENTION

In one embodiment of the invention, the invention is preferably comprised of a portable and disposable receptacle comprised of: a receptacle made of a leakproof material in a size and shape that can be gripped and squeezed by the user, wherein the receptacle contains an amount of oral cleaning solution for a one-time use; a straw or fitment affixed to the receptacle, which is adapted to form an airtight seal when placed within a user's lips; wherein the receptacle and straw or fitment are arranged to allow the user to dispense the oral cleaning solution from a user's mouth back into the receptacle after use; wherein the receptacle can be sealed after the oral cleaning solution is dispensed back into the receptacle after use so that the oral cleaning solution does not spill out of the receptacle; a cap secured to the straw or fitment to prevent spillage; a tether securing the cap to the straw or fitment; a baffle positioned in the straw or fitment to prevent spillage when the cap is removed and the straw or fitment is not sealed in the user's mouth; and wherein the receptacle can be disposed of after the one-time use. In an alternative embodiment, the receptacle is a multi-use device adapted to allow the user to remove the oral cleaning solution after use and to replenish the receptacle with new oral cleaning solution for future use. The multi-use receptacle is configured with a sealable opening (apart from the straw or fitment) for removing the used oral cleaning solution and for replenishing the receptacle with new oral cleaning solution. The sealable opening may be a formed from a plug or other type of sealed opening such as a zipped or slidably sealed opening.

The foregoing and other features and advantages of the present invention will be apparent from the following more detailed description of the particular embodiments, as illustrated in the accompanying drawings.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figures 1A, 1B, 2A, 2B, 3A, 3B, 4A, 4B:
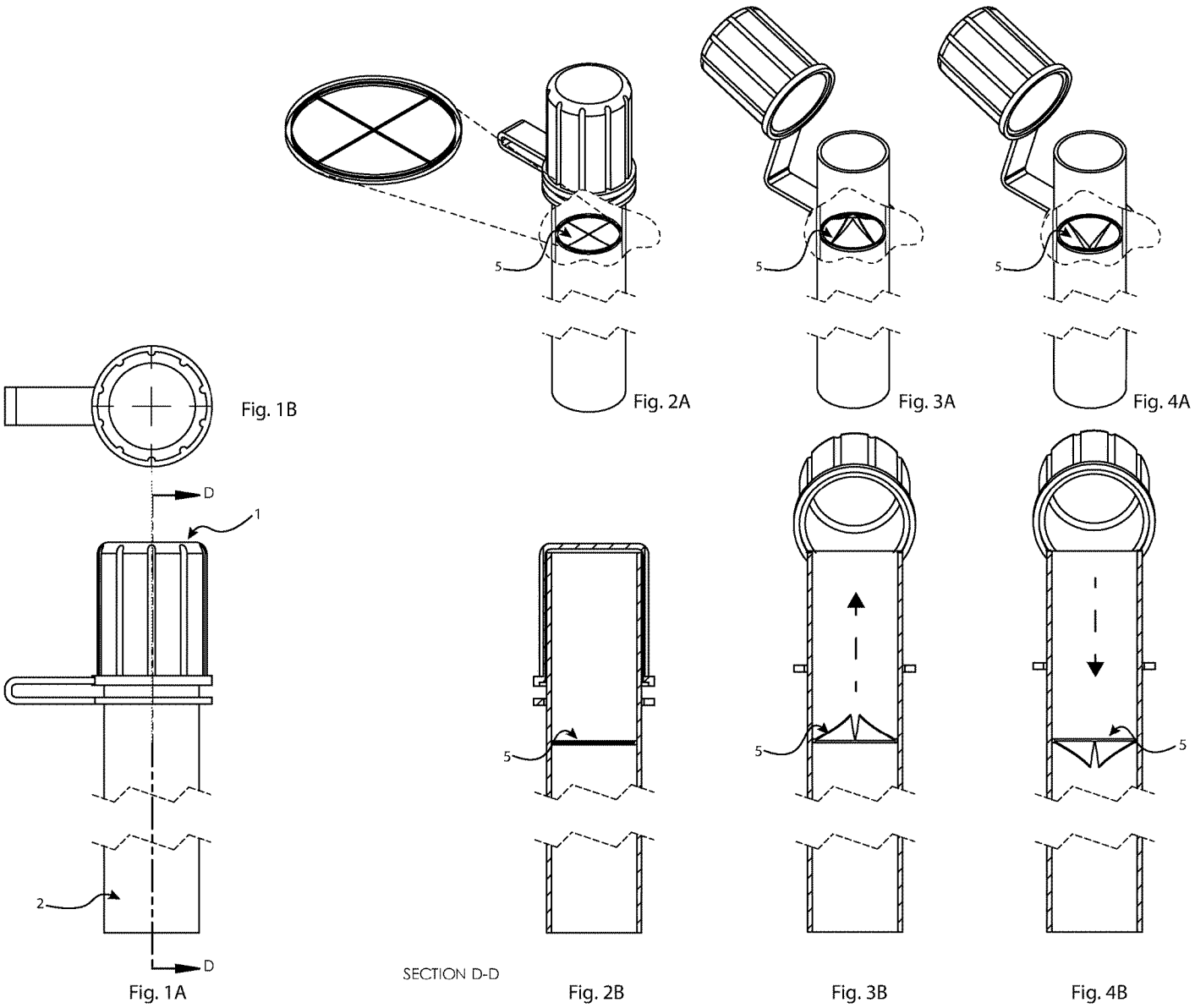
FIG. 1A illustrates one embodiment of the receptacle system of the present invention.
FIG. 1B illustrates a top view of one embodiment of the cap of the FIG. 1A.
FIG. 2A illustrates a view of the baffle of the present invention (interior of the receptacle showing baffle closed)
FIG. 2B illustrates a cross-section view of the receptacle shown in FIG. 1A taken along lines D-D (with baffle closed as shown in FIG. 2A)
FIG. 3A illustrates another view of the baffle of the present invention (interior of the receptacle showing baffle open towards user)
FIG. 3B illustrates another cross-section view of the receptacle shown in FIG. 1A taken along lines D-D (with baffle open towards user as shown in FIG. 3A)
FIG. 4A illustrates another view of the baffle of the present invention (interior of the receptacle showing baffle open away from user)
FIG. 4B illustrates another cross-section view of the receptacle shown in FIG. 1A taken along lines D-D (with baffle open away from user as shown in FIG. 4A)

The following detailed description of the exemplary embodiments refers to the accompanying figures which form a part thereof. The detailed description provides explanations by way of exemplary embodiments. It is to be understood that other embodiments may be used having design and mechanical changes that incorporate the scope of the present invention without departing from the spirit of the invention.

The present invention relates to a portable receptacle system having a straw or fitment that allows a user to dispense a flowable substance from the receptacle into the oral cavity and collect the same substance back into the receptacle, while away from a sink or other external waste receptacle. For example, the substance might be mouthwash or some other oral cleaning substance or solution. The present invention provides a portable, one-time use, oral cleaning pouch or receptacle that may be disposed after use. The embodiments described herein are exemplary embodiments and are not intended to limit the scope of the inventions claimed. For example, the receptacle of the present invention preferably has a straw or fitment for dispensing the solution into the user's mouth and back into receptacle for disposal after use. The receptacle system of the present invention may contain a baffle to restrict spillage. The system can be a one-time use or multiple use. For a multi-use embodiment, the user can refill the receptacle. In one embodiment, the user can refill the receptacle using the straw or fitment or the cap can be removable to allow the oral cleaning solution to be replenished. In another embodiment, the receptacle can be configured with another sealable opening for removing the used oral cleaning solution and for replenishing the receptacle with new oral cleaning solution.

FIG. 1 illustrates one embodiment of the receptacle system of the present invention. In this embodiment, the system of the present invention is comprised of a cap with tether 1, straw 2, and receptacle portion 3, the receptacle portion not shown in FIGS. 1-5.

In the embodiment of FIG. 1, there is a cap which can screw off, flip off or be removed by another method. The cap is affixed to the straw or fitment by a tether to prevent misplacement during use.

The cap fits on the straw or fitment upon which the user places the lips. In FIG. 1, a cylinder shape is shown, much like a straw, which reaches to the bottom of the receptacle, and can be either parallel to or at an angle to the receptacle. In another embodiment the piece may be a fitment molded to the top of the receptacle but not extending through the receptacle. In one embodiment the end of the straw that is engaged by the user's mouth may be configured with a larger opening so that it is easier for the user to dispense the oral solution back into the receptacle after use.

The receptacle may be manufactured from plastic, metal, coated paper or other liquid retention, leakproof material. The receptacle can take the form of different shapes, e.g., square, rectangular, circular or oval. In the preferred embodiment, the receptacle can be squeezed to force the oral solution out of the receptacle and then can expand when the solution is dispensed from the user's mouth back into the receptacle.

In one embodiment, the receptacle of the present invention is adapted so the user can replenish the liquid. In this embodiment, the receptacle is sized to contain enough of the oral cleaning solution to allow the user to clean his or her mouth one time—the receptacle can then be refilled with new oral solution for future use. In another embodiment, the invention is disposable, with a small, disposable, receptacle containing enough oral solution for a one-time use. The small, disposable, receptacle can be a small pouch or bottle that is sized to hold an amount of oral solution needed for a one-time use. After using the disposable embodiment of the invention, the user can dispense the solution from his or her mouth back into the receptacle for proper disposal.

The following steps describe the process for using the receptacle of the present invention as shown in FIG. 1:

1. User detaches cap from straw or fitment by unscrewing or lifting up. The cap falls free but is restrained by the tether;
2. User brings receptacle to lips;
3. User places the straw or fitment part way into mouth and closes lips to form a seal;
4. User dispenses substance into the mouth by squeezing receptacle. User may tilt head back to dispense if desired;
5. User swishes substance in mouth, or gargles, depending upon the use, keeping mouth closed to secure substance;
6. When finished rinsing or gargling, user once again places lips around straw or fitment to create a seal and evacuates the contents of mouth back into receptacle; and
7. User places tethered cap back on straw or fitment, creating a leakproof container which can be disposed of when convenient.

Figure 5:
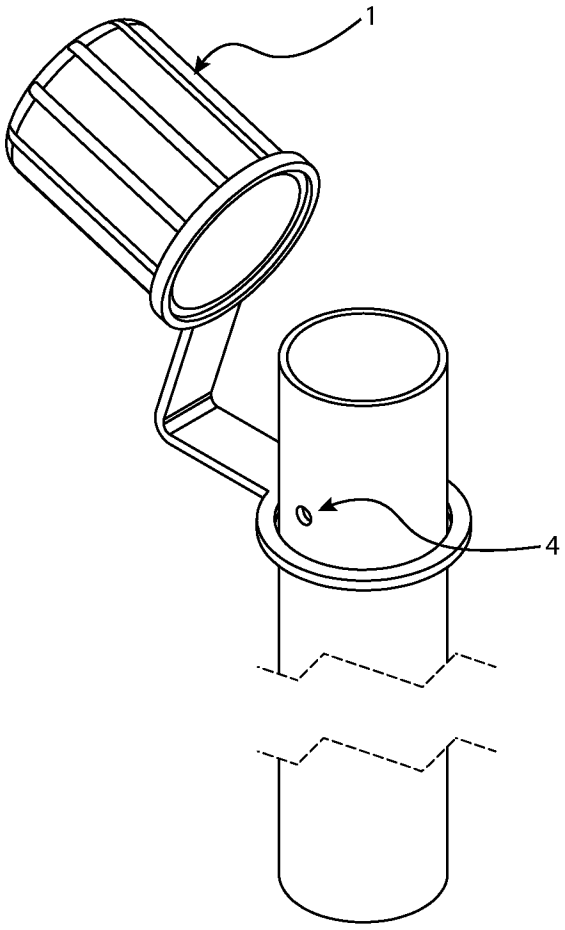
FIG. 5 illustrates another view of the receptacle of the present invention with the cap off showing the air vent in the straw.

FIG. 5 illustrates one embodiment of the invention having a vent 4 in the straw 2, and cap 1. The vent is covered by the cap. When the cap is removed and the straw is placed between the user's lips, the vent enables the substance to flow freely out of and back into the receptacle, minimizing the effort required by the user.

FIGS. 2A, 2B, 3A, 3B, 4A, 4B illustrate various views of the FIG. 1 embodiment of the invention showing an interior view (dotted lines) of the straw and baffle 5 as it relates to the cap 1 and straw 2. The baffle is preferably fitted within the straw as shown. FIGS. 2A, 2B, 3A, 3B, 4A, 4B show the baffle in various positions of use. FIG. 2B is a cross-section view of FIG. 2A taken along lines D-D of FIG. 1A. FIG. 3B is a cross-section view of FIG. 3A taken along lines D-D of FIG. 1A (except that the cap is off the straw in FIGS. 3A, 3B). FIG. 4B is a cross-section view of FIG. 4A taken along lines D-D of FIG. 1A (except that the cap is off the straw in FIGS. 4A, 4B). In FIGS. 2A, 2B, the baffle remains in a closed position when the cap is removed, thus inhibiting spillage or leakage before or after use. When the user dispenses the solution into the mouth (e.g., by squeezing the receptacle, thus causing the contents to flow into the straw and then into the mouth) the baffle opens to allow the solution to flow freely, see FIG. 3A, 3B. When the user expels the solution back into the receptacle, the action causes the baffle to open in the opposite direction, see FIGS. 4A, 4B.

Figure 6:
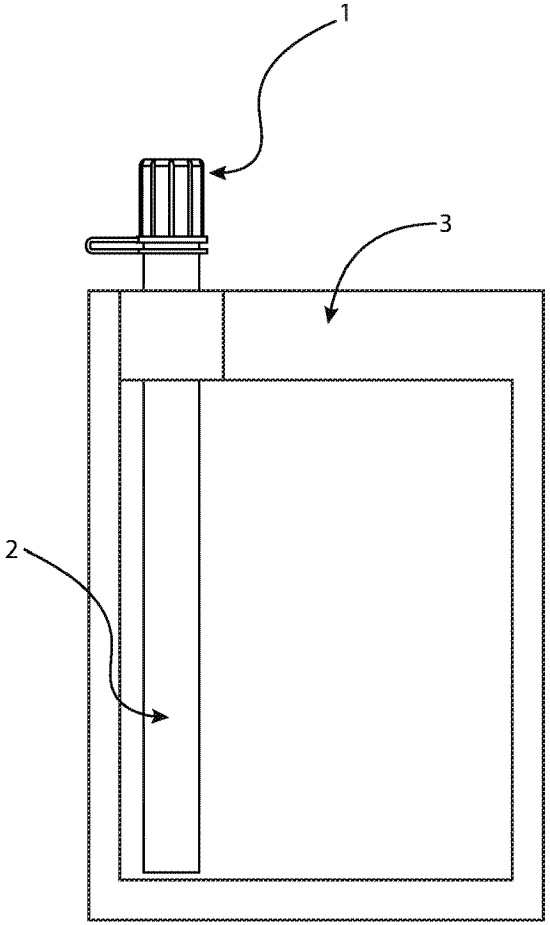
FIG. 6 illustrates one embodiment of the receptacle of the invention (with straw straight up and down)
Figure 7:
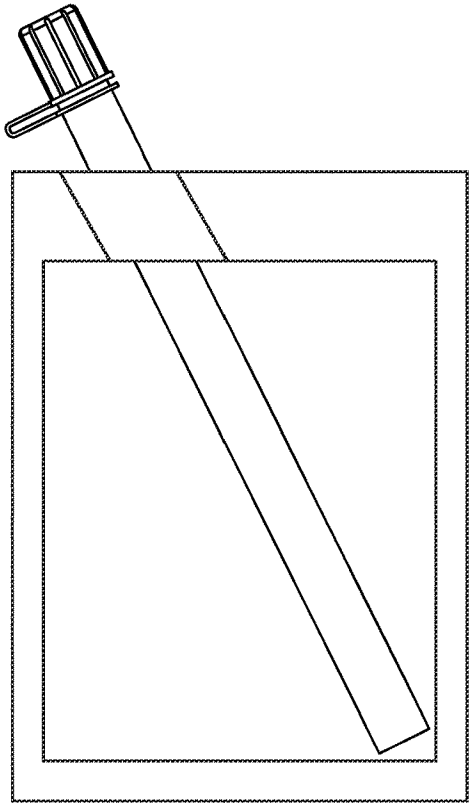
FIG. 7 illustrates one embodiment of the receptacle of the invention (with straw angled in the receptacle)
Figure 8:
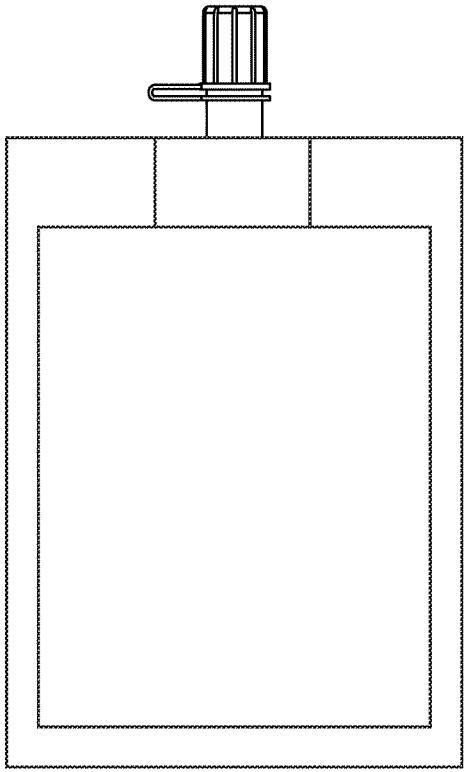
FIG. 8 illustrates one embodiment of the receptacle of the invention (with fitment opening).

FIGS. 6-8 illustrate different configurations of the straw or fitment. In FIGS. 6-8, the cap shown as 1, the tether as 2, and the receptacle as 3. In these embodiments, the receptacle has a transparent body portion which allows users to see into the pouch to view the straw and internal contents (the user can see the amount of mouth rinse stored in the pouch). In FIG. 6 the straw is shown in a perpendicular position, while in FIG. 7 the straw is shown in an angled position. FIG. 8 illustrates the invention with a fitment designed to be placed around the user's lips, rather than a straw.

While certain embodiments of the present invention are described in detail above, the scope of the invention is not to be considered limited by such disclosure, and modifications are possible without departing from the spirit of the invention as evidenced by the following claims:

What is claimed is:

1. A portable and disposable receptacle comprised of:

a. a receptacle made of a leakproof material in a size and shape that can be gripped and squeezed by the user, wherein the receptacle contains an oral rinse solution amounting to a one-time oral mouth rinse, and wherein the receptacle is configured to a predetermined size to hold the oral rinse solution amounting to a one-time oral mouth rinse and no more;

b. a straw or fitment operationally engaged to receptacle;

c. wherein the receptacle is configured to allow the user to dispense the oral rinse solution from a user's mouth back into the receptacle after use;

d. wherein the receptacle can be sealed after the oral rinse solution is dispensed back into the receptacle after use, so that the oral rinse solution does not spill out of the receptacle;

e. wherein the receptacle can be disposed of after the one-time use; and f. an air vent in the straw to allow the oral rinse solution to flow more easily out of the straw during use.

2. The disposable receptacle of claim 1, further comprising:

a. a cap removably secured to the straw or fitment to prevent spillage; and b. a tether secured to the cap to the straw or fitment.

3. The disposable receptacle of claim 2, further comprising:

a. a baffle positioned in the straw or fitment to prevent spillage when the cap is removed and the straw or fitment is not sealed in the user's mouth.

4. The disposable receptacle of claim 3, wherein the baffle is adapted to open towards the user's mouth to allow the oral rinse solution to enter the user's mouth and the baffle is adapted to open away from the user's mouth when the oral solution is dispensed back into the receptacle.

5. The disposable receptacle of claim 1, wherein the receptacle is comprised of recyclable material that allows the receptacle to be disposed of after use.

6. The disposable receptacle of claim 1, wherein one end of the straw or fitment that is engaged by the user's mouth may be configured with a larger opening so that it is easier for the user to dispense the oral rinse solution back into the receptacle after use.

7. The disposable receptacle of claim 1, wherein the receptacle is comprised of a transparent body portion which allows users to see into the receptacle to view the straw and the amount of the oral rinse solution stored in the receptacle.

8. The disposable receptacle of claim 1, wherein the receptacle is a plastic pouch.

9. The disposable receptacle of claim 1, wherein the receptacle is a plastic bottle shape that can be squeezed.

10. The disposable receptacle of claim 1, where the receptacle is in a square or round shape.

11. A portable and disposable receptacle comprised of:

a. a receptacle made of a leakproof material in a size and shape that can be gripped and squeezed by the user, wherein the receptacle contains an oral rinse solution amounting to a one-time oral mouth rinse, and wherein the receptacle is configured to a predetermined size to hold the oral rinse solution amounting to a one-time oral mouth rinse and no more;

b. a straw or fitment affixed to the receptacle which is adapted to form an airtight seal when placed within a user's lips;

c. wherein the receptacle and straw or fitment are arranged to allow the user to dispense the oral rinse solution from a user's mouth back into the receptacle after use;

d. wherein the receptacle can be sealed after the oral rinse solution is dispensed back into the receptacle after use so that the oral rinse solution does not spill out of the receptacle;

e. a cap secured to the straw or fitment to prevent spillage;

f. a tether securing the cap to the straw or fitment;

g. a baffle positioned in the straw or fitment to prevent spillage when the cap is removed and the straw or fitment is not sealed in the user's mouth; and h. wherein the receptacle can be disposed of after the one-time use; and f. an air vent in the straw to allow the oral rinse solution to flow more easily out of the straw during use.

12. The disposable receptacle of claim 11, wherein the baffle is adapted to open towards the user's mouth to allow the oral rinse solution to enter the user's mouth and the baffle is adapted to open away from the user's mouth when the oral rinse solution is dispensed back into the receptacle.

13. The disposable receptacle of claim 11, wherein one end of the straw or fitment that is engaged by the user's mouth may be configured with a larger opening so that it is easier for the user to dispense the oral rinse solution back into the receptacle after use.

* * * * *